US009086031B2

(12) United States Patent
Williams et al.

(10) Patent No.: US 9,086,031 B2
(45) Date of Patent: Jul. 21, 2015

(54) CRACKED CAP BULKHEAD INSERT

(71) Applicant: Ford Global Technologies, LLC, Dearborn, MI (US)

(72) Inventors: Rick L. Williams, Canton, MI (US); Cliff Maki, New Hudson, MI (US); Jeffrey Allen Mullins, Allen Park, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 219 days.

(21) Appl. No.: 13/797,635

(22) Filed: Mar. 12, 2013

(65) Prior Publication Data

US 2014/0261285 A1 Sep. 18, 2014

(51) Int. Cl.

| | |
|---|---|
| ***F02B 67/00*** | (2006.01) |
| ***F02F 7/00*** | (2006.01) |
| *F02B 75/02* | (2006.01) |

(52) U.S. Cl.

CPC ..... *F02F 7/0021* (2013.01); *F02B 2075/025* (2013.01); *F02F 7/0007* (2013.01); *F02F 7/0012* (2013.01); *F02F 7/0053* (2013.01); *F05C 2201/021* (2013.01)

(58) Field of Classification Search

CPC ..... F02F 7/0053; F02F 7/0007; F02F 7/0012; F02B 2075/025; F05C 2201/021

USPC ..... 123/195 R

See application file for complete search history.

(56) References Cited

U.S. PATENT DOCUMENTS

| | | | | |
|---|---|---|---|---|
| 4,446,827 | A | 5/1984 | Kubozuka | |
| 4,475,508 | A | 10/1984 | Okada | |
| 4,520,771 | A | 6/1985 | Hayashi | |
| 4,569,317 | A | 2/1986 | Hayashi | |
| 4,911,118 | A | 3/1990 | Kageyama et al. | |
| 5,501,189 | A | 3/1996 | van Bezeij | |
| 5,501,529 | A | 3/1996 | Cadle et al. | |
| 5,564,837 | A | 10/1996 | Putnam et al. | |
| 5,829,406 | A * | 11/1998 | Mazzola et al. | 123/195 R |
| 6,076,971 | A | 6/2000 | Warwick et al. | |
| 6,990,943 | B2 | 1/2006 | Koyama | |
| 7,171,935 | B2 | 2/2007 | Komai et al. | |
| 7,284,528 | B2 | 10/2007 | Natkin et al. | |
| 8,151,758 | B2 | 4/2012 | Ni et al. | |
| 2002/0062795 | A1 | 5/2002 | Inoue et al. | |
| 2007/0209628 | A1 * | 9/2007 | Natkin et al. | 123/195 R |
| 2010/0050977 | A1 | 3/2010 | Park | |
| 2011/0048367 | A1 | 3/2011 | Zielke et al. | |

* cited by examiner

*Primary Examiner* — Lindsay Low
*Assistant Examiner* — Charles Brauch
(74) *Attorney, Agent, or Firm* — Greg Brown; Alleman Hall McCoy Russell & Tuttle LLP

(57) ABSTRACT

Various bulkhead inserts having a cracked cap are provided. In one example, a cylinder block includes a plurality of cylinder bores, a crankcase disposed below the cylinder block in a vertical direction, and a plurality of inserts, where each adjacent pair of inserts of the plurality of inserts partitions each cylinder bore of the plurality of cylinder bores. Each insert of the plurality of inserts has an upper portion and a cap disposed below the upper portion, the cap cracked from the upper portion and rejoined to the upper portion by one or more fastening devices, the upper having one or more upper bosses, each upper boss having a surface with extruded, circumferentially-extending serrations.

19 Claims, 5 Drawing Sheets

CRACKED CAP BULKHEAD INSERT

FIELD

The disclosure relates to internal combustion engines and particularly to bulkhead inserts in a cylinder block.

BACKGROUND AND SUMMARY

Cylinder or engine blocks form part of an internal combustion engine and may include cylinder bores at least partially forming spaces into which pistons may be inserted. A cylinder head may be disposed above the cylinder block to form the cylinders, while a crankcase may be disposed below the cylinder block to support a crankshaft. The cylinder block may include a plurality of bulkhead inserts to provide support to the crankshaft via bearings, couple the cylinder head to the overall cylinder block, and increase the stiffness and structural integrity of the block.

U.S. Pat. App. No. 2010/0050977 describes the inclusion of crankcase inserts in an engine block comprised of magnesium alloy. The crankcase inserts may be comprised of compacted graphite iron (CGI) and inserted below and between a plurality of cylinder chambers. Each insert includes a plurality of upper coupling parts which extend outward from a rectangular body in a parabolic spoke-like configuration, and provide connection mechanisms by which the inserts may be coupled to the engine block. The inserts may undergo a splitting process in which they are bisected along a crankshaft insertion hole and resulting upper and lower portions are attached to each other following crankshaft insertion.

The inventors herein have recognized several issues with such an approach. First, the upper coupling parts may be limited in the amount of force they can support, due to their outwardly extending spoke-like configuration. Such extension further increases the volume and mass of the inserts. Moreover, spacing between adjacent cylinder bores in the engine block may be increased due to the volume occupied by the upper coupling parts. Finally, the spoke-like configuration may limit mitigation of cylinder bore distortion during engine operation.

Bulkhead inserts having a cracked cap and an improved structure for strength and stiffness are provided.

In one example, a cylinder block includes a plurality of cylinder bores, a crankcase disposed below the cylinder block in a vertical direction, and a plurality of inserts, where each adjacent pair of inserts of the plurality of inserts partitions each cylinder bore of the plurality of cylinder bores. Each insert of the plurality of inserts has an upper portion and a cap disposed below the upper portion, the cap cracked from the upper portion and rejoined to the upper portion by one or more fastening devices, the upper having one or more upper bosses, each upper boss having a surface with extruded, circumferentially-extending serrations. The plurality of inserts may be comprised of compressed graphite iron.

In this way, the overall weight of a cylinder block may be reduced, in turn improving fuel economy. The plurality of inserts may further facilitate a reduction in noise, vibration, and harshness, required machining, crankshaft weight, and a number of fastening devices needed to secure the inserts in the cylinder block.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Cylinder blocks may include a plurality of bulkhead inserts to reinforce the block and improve load distribution throughout the block. Some bulkhead inserts may be vertically oriented, perpendicular to a crankshaft axis, and include a bore to support insertion and rotation of a crankshaft. Conventional bulkhead inserts comprised of cast iron, however, cannot be cracked or otherwise segmented into two or more pieces, increasing the difficulty of crankshaft insertion and cylinder block assembly, and requiring additional machining.

Figure 1:
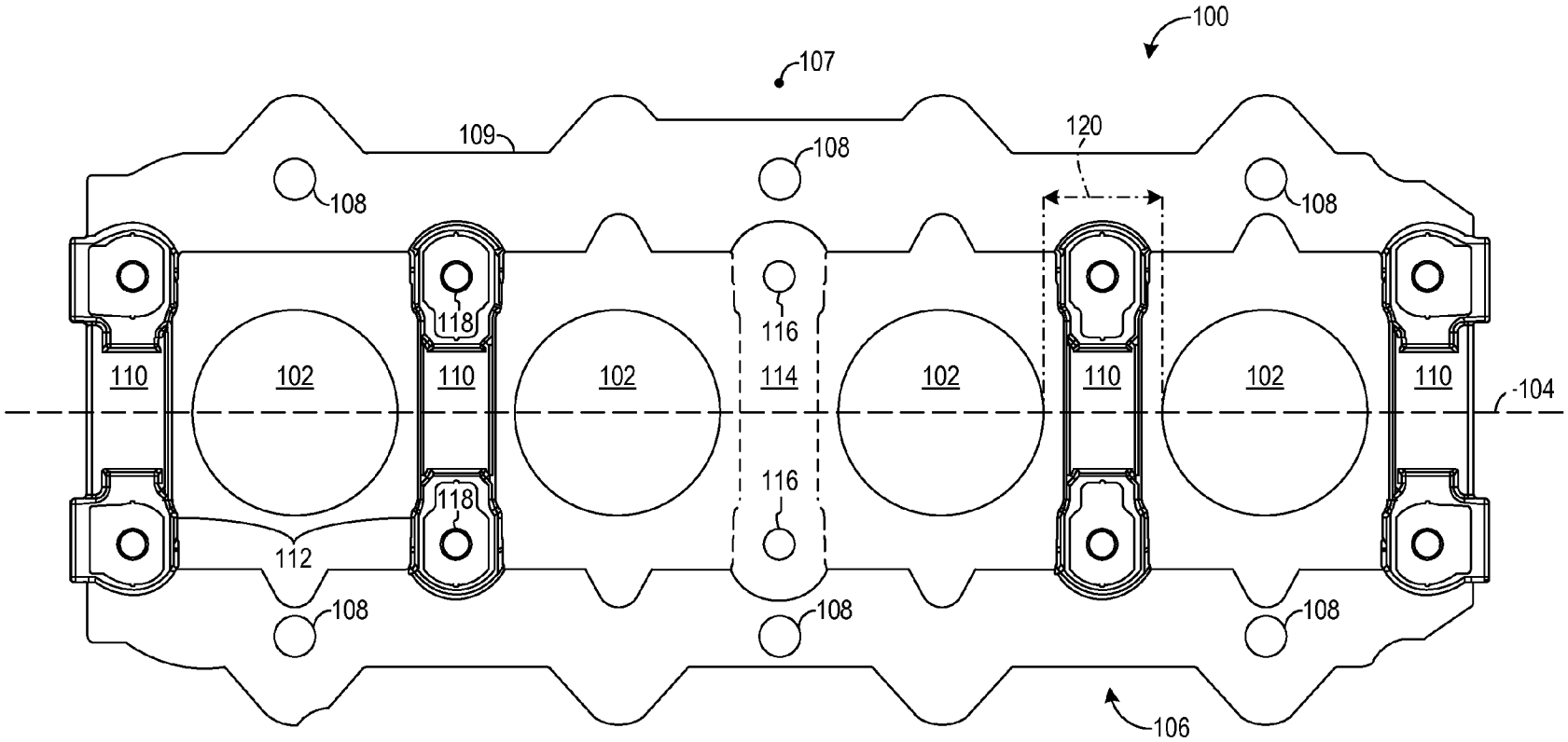
FIG. 1 shows a schematic diagram of a cylinder block including a plurality of bulkhead inserts in accordance with the present disclosure.
Figure 2:
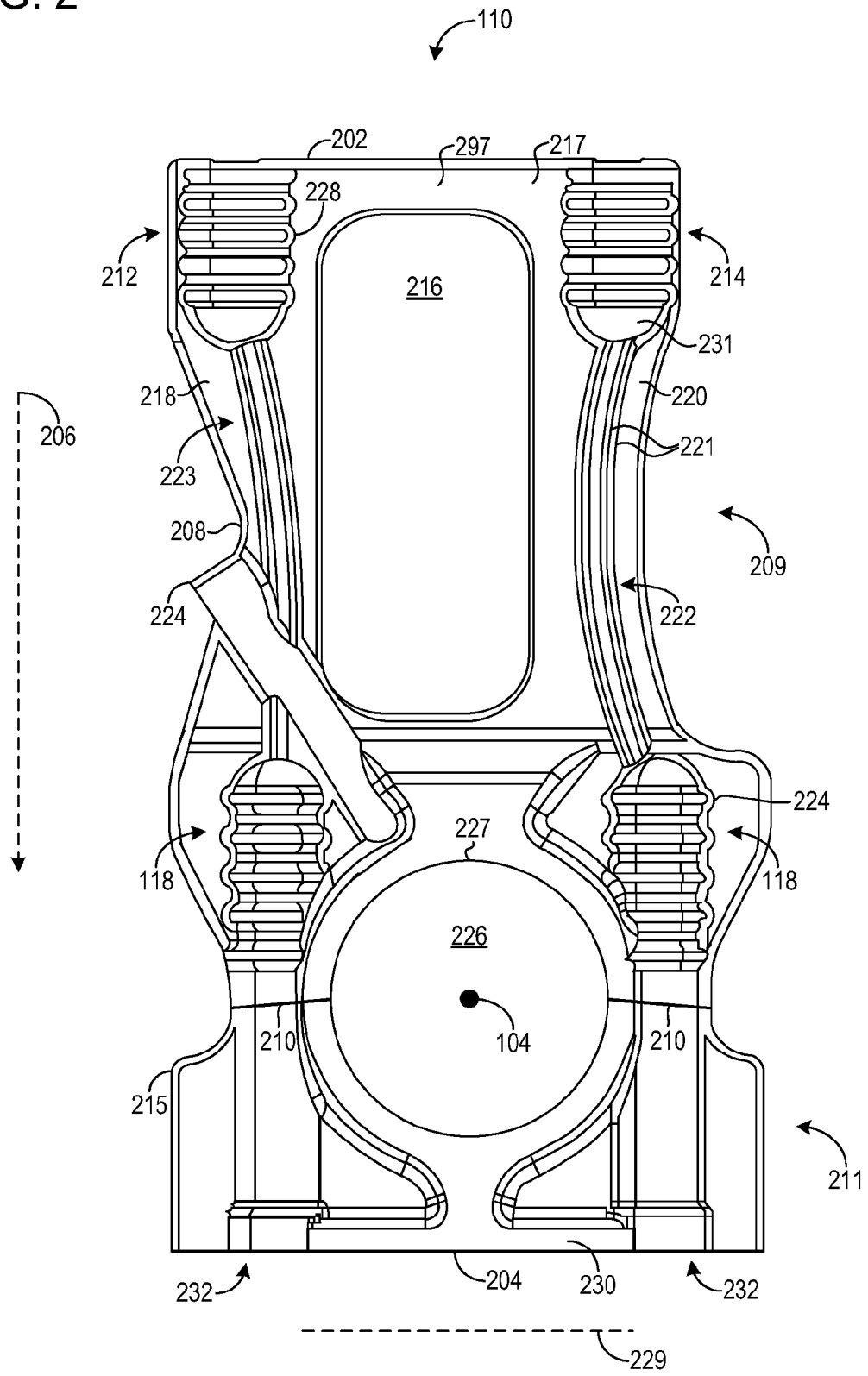
FIG. 2 shows a schematic diagram of a bulkhead insert having a cracked cap in accordance with the present disclosure.
Figure 3:
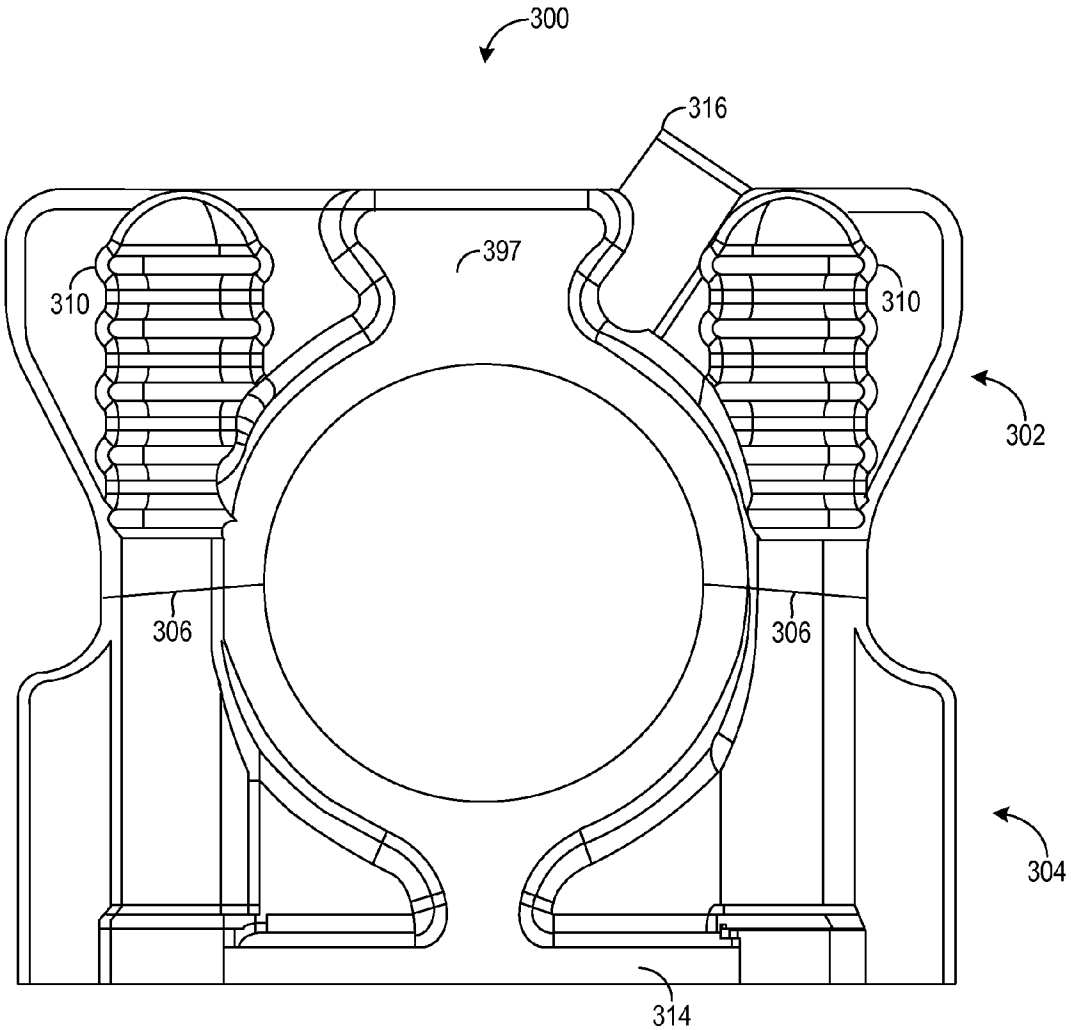
FIG. 3 shows a schematic diagram of another embodiment of a bulkhead insert having a cracked cap in accordance with the present disclosure.
Figure 4:
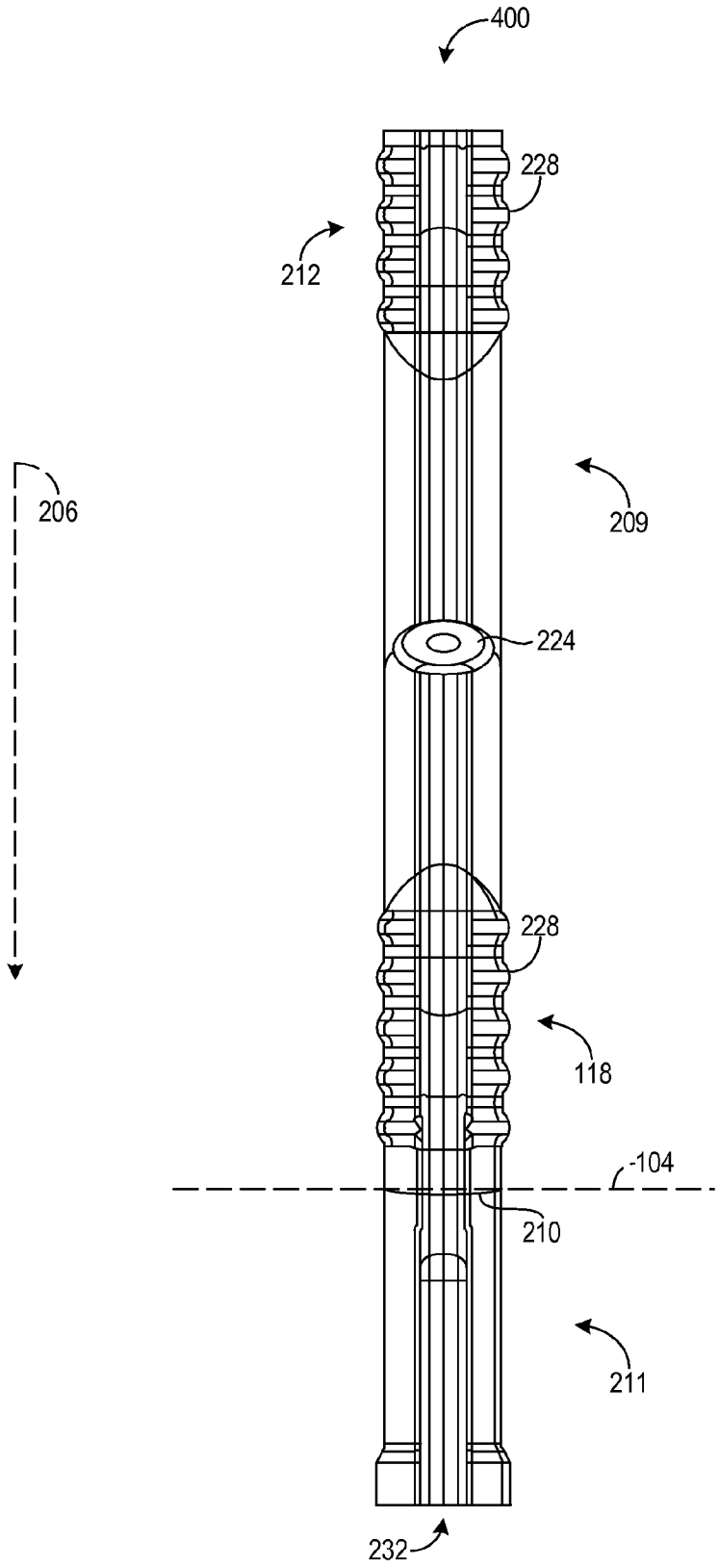
FIG. 4 shows a schematic diagram of a left side view of the bulkhead insert of FIG. 2.
Figure 5:
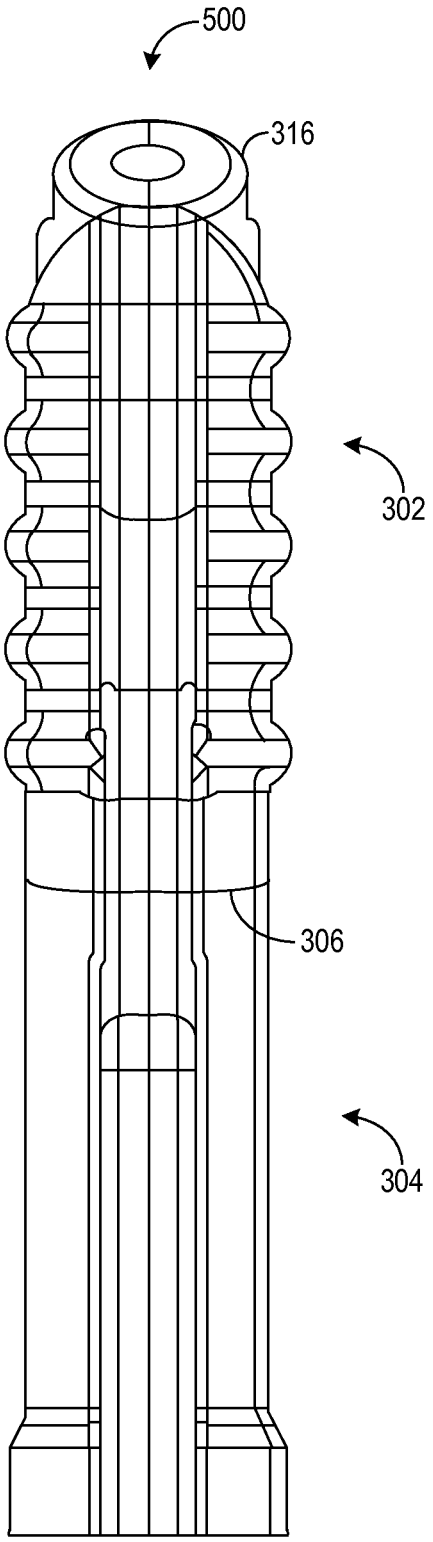
FIG. 5 shows a schematic diagram of a right side view of the bulkhead insert of FIG. 3.

Bulkhead inserts having a cracked cap and an optimized structure for strength and stiffness are provided. In some embodiments, the inserts may include an upper portion and a cap disposed below the upper portion, the cap cracked from the upper portion and rejoined to the upper portion by one or more fastening devices. The upper portion may have one or more upper bosses, with each upper boss have a surface with extruded, circumferentially-extending serrations. The inserts may be comprised of compressed graphite iron or sintered metal. FIG. 1 shows a schematic diagram of a cylinder block including a plurality of bulkhead inserts in accordance with the present disclosure. FIG. 2 shows a schematic diagram of a bulkhead insert having a cracked cap in accordance with the present disclosure, FIG. 3 shows a schematic diagram of another embodiment of a bulkhead insert having a cracked cap in accordance with the present disclosure, and FIG. 4 shows a schematic diagram of a left side view of a bulkhead insert having a cracked cap in accordance with the present disclosure. FIG. 5 shows a schematic diagram of a right side view of a bulkhead insert having a cracked cap in accordance with the present disclosure.

FIG. 1 is a schematic diagram of an exemplary cylinder block 100, which may be included in a propulsion system of an automobile. Specifically, FIG. 1 shows a bottom view of cylinder block 100. Cylinder block 100 is shown with four cylinder bores 102, though other numbers of cylinders and other configurations (e.g., separated cylinder banks as in a V engine) may be used in accordance with the present disclosure. Each combustion chamber partially formed by cylinder bores 102 may include combustion chamber walls with a piston (not shown) positioned therein. The pistons may be coupled to a crankshaft (not shown) extending along a crankshaft axis 104 so that reciprocating motion of the piston is translated into rotational motion of the crankshaft. Cylinder block 100, along with other components described below, may be integrally formed using any suitable process, for example a sand casting or high pressure die casting process. Further, cylinder block 100 may be comprised of a plurality of materials, non-limiting examples including cast iron and aluminum.

Cylinder block 100 may include additional components integrally cast during formation of the cylinder block, and/or may be attached to such additional components. For example, cylinder block 100 may include a crankcase 106 disposed therebelow along a vertical direction 107, which extends out of the page of FIG. 1. Crankcase 106 may encase a crankshaft extending along crankshaft axis 104 and may include an oil well (not shown) positioned below the crankshaft. Crankcase 106 may include an oil fill port (not shown) such that oil may be supplied to the oil well. A dip stick tube (not shown) may also be disposed in crankcase 106 for measuring a level of oil in the oil well. Crankcase 106 may enable lubrication of the crankshaft, and oil may be circulated throughout cylinder block 100 via an oil pump (not shown) to lubricate other components (e.g., a camshaft and other drive shafts). Finally, crankcase 106 may include a plurality of orifices 108 for servicing components in the crankcase and cylinder block 100. Orifices 108 may be selectively opened and closed during engine operation in embodiments in which a crankcase ventilation system (not shown) is included. Such a crankcase ventilation system may vent gases out of crankcase 106 into an engine intake manifold (not shown) to provide continual evacuation of gases from inside crankcase 106 in order to reduce degradation of various engine components in the crankcase.

Crankcase 106 may include a plurality of walls extending downward along vertical direction 107 along its perimeter, which may be connected to form a contiguous crankcase skirt 109. Crankcase skirt 109, like other components in cylinder block 100, may be integrally cast with crankcase 106 and/or cylinder block 100, or may be separately attached during an assembly process. Skirt 109 may increase enhance the structural rigidity of crankcase 106 and/or cylinder block 100, and may extend vertically downward along vertical direction 107 in lengths which may be adjusted according to various desired characteristics. For example, skirt 109 may have a relatively short vertical length and accordingly designated as a "short skirt". In this embodiment, the short skirt 109 may extend vertically downward along vertical direction 107 from a bottom surface of cylinder block 100 to become substantially flush with crankshaft axis 104. Alternatively, skirt 109 may extend farther vertically downward beyond crankshaft axis 104. In this embodiment, skirt 109 may be designated as a "deep skirt".

Cylinder block 100 may further include a cylinder head (not shown) disposed above cylinder block 100 along a direction opposite vertical direction 107 to thereby form the combustion chambers. The cylinder head may be coupled and sealed to cylinder block 100 via one or more head gaskets, for example. The cylinder head may also provide regions at which intake and exhaust valves, fuel injectors, and spark plugs may be installed. In this way, the combustion chambers may receive fuel from one or more fuel injectors and intake air from an intake manifold to enable fuel combustion. Alternatively or in addition to the oil well described above, the block may be coupled with a structural oil pan therebelow.

As described above, cylinder block 100 may be integrally cast with the components described above, including crankcase 106 and a cylinder head. Alternatively, such components may be separately formed and later joined together. The components, including cylinder block 100 and crankcase 106, may be formed using any suitable process without departing from the present disclosure, including sand casting and high pressure die casting. Such components may be comprised of various suitable materials, including cast iron and aluminum. Use of aluminum may, for example, reduce the overall weight of cylinder block 100 and its associated overall engine, in turn improving performance and efficiency in a vehicle into which the cylinder block is disposed.

Continuing with FIG. 1, cylinder block 100 may include a plurality of bulkhead inserts 110, which may be configured to reinforce the cylinder block, and improve its stiffness structural integrity, and load distribution. The inserts may also be configured to withstand significant explosive forces and thermal stress produced during operation of an engine associated with cylinder block 100, and significant changes in pressure produced by piston movement in cylinder bores 102.

Five inserts 110 are shown in the illustrated example, though this number may be varied without departing from the scope of this disclosure, and may equal the number of cylinder bores (e.g., five) 102 in cylinder block 100. In the illustrated embodiment, adjacent pairs of inserts 110 partition and separate successive cylinder bores 102. For example, an adjacent pair of inserts 112 partitions and separates leftmost cylinder bore 102 from an adjacent cylinder bore 102 in a rightward direction along crankshaft axis 104. Inserts 110 may substantially span the vertical length of cylinder block 100 and extend throughout a cylinder head and crankcase 106, as further discussed below with reference to FIG. 2.

Inserts 110 may be installed into cylinder block 100 from below; in other words, inserts 110 may first be inserted into crankcase 106. In some embodiments, the inserts may extend vertically along vertical direction 107 from crankcase 106 through cylinder block 100 and to a cylinder head disposed thereabove. In other embodiments, the inserts may extend vertically along vertical direction 107 from crankcase 106, truncating at a region corresponding to cylinder block 100, before a cylinder head.

Cylinder block 100, and crankcase 106, may include a plurality of insertion spaces whose number may correspond to the number of bulkhead inserts 110. The insertion spaces may provide a region into which inserts 110 may be installed, and may have a geometry facilitating the secure insertion and holding of inserts 110. For example, an insertion space 114 is shown for the sake of illustration, showing how an insert may be securely installed into cylinder block 100. In some embodiments, cylinder block 100, and particularly a cylinder head disposed thereabove, includes a pair of block bosses 116 at each insertion space 114. Each block boss 116 may be configured to receive a fastening device (e.g., bolt) inserted from the cylinder head along vertical direction 107 and couple (e.g., via threads) the cylinder head and cylinder block 100 to each insert 110. Moreover, each insert 110 may include a pair of cap bosses 118, which may each receive a fastening device inserted from below opposite vertical direction 107 to secure the insert in cylinder block 100, as described in further detail with reference to FIGS. 2 and 3. FIGS. 2-3 are drawn approximately to scale.

Turning now to FIG. 2, a front view of an exemplary bulkhead insert 110 is shown. Insert 110 may be comprised of various suitable materials, for example compressed graphite iron (CGI) or sintered metal. Usage of CGI, for example, may decrease insert weight compared to inserts comprised of other materials (e.g., cast iron), which may in turn increase the power density of an engine using cylinder block 100. Conversely, alloy properties of sintered metal may facilitate customized mechanical properties of insert 110, for example. Insert 110 may be manufactured using various suitable processes, which may be similar to those used in the formation of a cast-in iron liner, and may be cast in place during formation of cylinder block 100, for example.

In the illustrated embodiment, insert 110 has a substantially rectangular but asymmetric profile with a varied perimeter including angled and curved portions. Insert 110 may include a top surface 202 and a bottom surface 204, each of which may be substantially flat to promote secure installation in cylinder block 110 and thorough sealing with adjacent components. As traversed along a vertical direction 206 on its left side, insert 110 in this illustrated embodiment has the following perimeter or edge portions: a substantially vertical edge, a linear, inwardly angled edge culminating at an inflection point 208, a linear, outwardly angled edge joined to the inwardly angled edge at inflection point 208 by a concave region, a second linear, inwardly angled edge joined to the outwardly angled edge by a convex region, and a second concave region joined to a bottom substantially vertical edge. As also traversed along vertical direction 206 but on its right side, insert 110 has the following perimeter or edge portions: a substantially vertical edge, a longer concave region, a short convex region joining the concave region to a second substantially vertical edge followed by a second concave region, and finally a bottom substantially vertical region. It will be appreciated that some edge or perimeter portions may possess substantially the same lengths as their stereo counterparts (e.g., left bottom vertical region may have the same length as its right counterpart). However, the lengths and shapes of such edge portions may be varied without departing from the scope of this disclosure and may be tailored to surrounding components in cylinder block 100.

In some embodiments, insert 110 includes an upper portion 209 and a lower portion or cap 211, which is disposed below upper portion 209 along vertical direction 206 and separated from upper portion 209 along a pair of cracks or fault lines 210, described in further detail below. Upper portion 209 thus some in some embodiments may comprise the majority of insert 110, including linear, convex, concave, and angled edge or perimeter portions.

Upper portion 209 may include a pair of upper bosses—a left upper boss 212 and a right upper boss 214—which each may facilitate secure attachment of insert 110 to surrounding portions of cylinder block 100 (e.g., a cylinder head). Upper bosses 212 and 214 may each receive a fastening device to thereby secure insert 110 in cylinder block 100. In some embodiments, upper bosses 212 and 214 are threaded, substantially cylindrical, and configured to receive a threaded bolt. Once insert 110 is placed in insertion space 114 of cylinder block 100, bolts may be inserted in upper bosses 212 and 214 (e.g., downward through a cylinder head), securing the insert in the cylinder block. In such an approach, two fastening devices (e.g., bolts) are required to securely install insert 110 into cylinder block 100, which may reduce part count and weight compared to other approaches in which more than two fastening devices are needed. Further, upper bosses 212 and 214 extend along vertical direction 206 in a top portion of upper portion 209 of insert 110 and, in some embodiments, may be surrounded and enclosed by an outer perimeter 215 of insert 110. Restricting upper bosses 212 and 214 to this top region may minimize the engagement required between the upper bosses and fastening devices, and may reduce thermal distortion in cylinder bores 102 and other components in cap 211 during engine operation.

Upper portion 209 includes a port 216 which, in this example, is substantially rectangular hollow region having rounded corners. Port 216 may be formed with a mold or casting during formation of insert 110, or may be machined out following formation of the insert. Port 216 in this example extends vertically from a region between upper bosses 212 and 214, terminating before reaching cap 211. Being a hollow region, port 216 may facilitate fluidic communication among adjacent combustion chambers and thereby reduce pressure fluctuation among the combustion chambers.

While upper portion 209 is shown as being contiguous in this example, port 216 may substantially divide loads placed on insert 110 into two smaller, substantially evenly distributed loads each respectively acting on a left rib 218 and a right rib 220. Left and right ribs 218 and 220 may substantially correspond to a left section and a right section of insert 110, respectively, and may more evenly distribute loads imparted to insert 110 and increase the structural stiffness of the insert. In particular, left and right ribs 218 and 220 may distribute loads carried by upper bosses 212 and 214 to stronger parts of insert 110. Further, left and right ribs 218 and 220 may connect upper bosses 212 and 214 to respective cap bosses 118 below. In this way, loads imparted to the insert are optimally distributed throughout its body.

Upper portion 209 further includes a plurality of spines 221 which in this example are shown as curved, extruded ridges extending along an exterior surface 217 of insert 110. The spines may improve the structural stiffness of insert 110 and the distribution of loads throughout the insert. A right set of spines 222 substantially spans the vertical length of upper portion 209, being joined to right upper boss 214, extending downward therefrom, and joining a respective cap boss 118. In this example, right set of spines 222 comprises four individual spines, though virtually any number of spines may be included without departing from the scope of this disclosure. It will be appreciated that spines in a set of spines (e.g., right set of spines 222) may be equally or unequally spaced, where such spacing may be adjusted based on the physical properties of insert 110 and loads imparted to the insert.

The insert 110 may include a flat web 297 extending between the upper bosses to improve the structural rigidity of the block and reduce weight, while maintaining close cylinder-to-cylinder spacing. For example, the web may be integrally formed with the insert and comprise a generally flat extension connecting the two outer bosses, where the web is thinner than the outer surfaces of the bosses. The web may define an upper boundary of port 216 such that port 216 is fully enclosed by the insert, without any circumferential opening around port 216 through the insert.

Insert 110 may similarly include a left set of spines 223, which are also curved, extruded ridges disposed on exterior surface 217 of the insert. Left set of spines 223 comprises four spines joined to and extending downward from upper left boss 212. However, left set of spines 223 truncates at a lubricant passage 224, which is configured to receive and supply a lubricant (e.g., oil) to various components in insert 110 and cylinder block 100. Lubricant passage 224, for example, may distribute a high-pressure, filtered engine lubricant to a crankshaft bearing journal 227, which is configured to support a crankshaft inserted and extending through a crank bore 226 along crankshaft axis 104, which in this example is centrally aligned with crank bore 226. Lubricant passage 224 may improve load and force distribution throughout insert 110. In some examples, a load imparted to insert 110 may travel from bearing journal 227, into cap 211, back into cap bosses 118 and their associated fastening devices, and finally upwardly throughout insert 110 and to various components at its top end. Omission of lubricant passage 224 may cause the formation of a high stress gradient and separation or cracking at casting interfaces, which may then cause lubricant leakage. Lubricant passage 224 may further distribute loads to upper bosses 212 and 214. Lubricant passage 224 may receive lubricant from an oil pump drawing oil from an oil well, as described above. Note that the oil passage is positioned and shaped so that there are no bi-metal cuts, thus reducing stress gradients.

Insert 110 may further include a plurality of serrations 228. Like spines 221, serrations 228 in this example are formed as curved, extruded ridges disposed on the exterior surfaces (e.g., exterior boss surface 231) of upper bosses 212 and 214, and cap bosses 118. However, serrations 228 are substantially aligned with a horizontal axis 229, and extend circumferentially around upper and cap bosses 212, 214, and 118 to thereby surround the bosses. As traversed along vertical direction 206, the horizontal lengths of serrations 228 may alternately vary such that adjacent pairs comprise a relatively short serration above or below a relatively long serration. Such a pattern may impart a sinuous external structure or perimeter to the bosses. In some embodiments, formation of serrations 228 may be used to form threads in bosses 212, 214, and 118. The serrations may prevent degradation of bonds between insert 110 and the surrounding cylinder block 100, especially in embodiments in which the cylinder block comprises aluminum.

Various parts of insert 110 may be cooperatively formed to produce various advantages. For example, port 216 may cooperate with spines 221 and/or serrations 228 to increase the overall strength of insert 110 and improve load distribution throughout the insert. In this way, stress concentration in isolated locations may be reduced.

Insert 110 includes lower portion 211, disposed below upper portion 209 along vertical direction 206. Lower portion 211 may be equally referred to as a "cap", "cracked cap", "fracture", or "fractured cap". In some embodiments, insert 110 is integrally formed. Following formation, cap 211 is cracked or severed along cracks 210, which in this example are angled upwardly from and relative to horizontal axis 225. A crankshaft is then inserted along crankshaft axis 104 into cylinder block 100. Finally, cap 211 is reattached to upper portion 209 via one or more fastening devices. For example, a pair of bolts may be inserted and threaded into respective cap bosses 118 through respective cap boss ports 232 from below, opposite vertical direction 206. Such an approach may facilitate the formation of crank bore 226 through which a crankshaft may be inserted, which may include a journal bearing to support the crankshaft.

The above described approach, in which cap 211 is cracked from insert 110 and rejoined to upper portion 209 via one or more fastening devices, may present various advantages over other approaches. For example, the amount of machining required for the formation of a bulkhead insert may be reduced. The stability of crank bore 226 may also be improved, which may in turn reduce noise, vibration, and harshness (NVH) associated with insert 110 and cylinder block 100. The described approach may also increase stiffness of cylinder block 100 toward its lower end (e.g., proximate crankcase 106), especially in cylinder blocks comprising aluminum. The use of saddle press caps may be omitted due to improved alignment between cap 211 and upper portion 209 as the two are rejoined. Crankshaft weight may be reduced due to increased stability of crankcase 106. Finally, the load carrying capacity of cylinder block 100 may be increased.

Insert 110 may also include a dovetail region 230, which in one embodiment is a raised, extruded surface extending outward from external surface 217. Dovetail region 230 may extend from bottom surface 204, substantially surround crank bore 226, truncate at upper portion 209, and at least partially abut cap bosses 118. The dovetail region may enhance the structural stiffness of insert 110 and reduce thermal distortion in crank bore 226.

Turning back to FIG. 1, insert 110 may provide additional advantages related to thermal distortion. Due to its geometry and dimensions, each insert 110 may reduce thermal distortion in cylinder bores 102. Further, the width of each insert 110, as seen from the perspective in FIG. 1, may be minimized such that the widths between successive cylinder bores may be reduced, in turn reducing the weight and size of cylinder block 100. In particular, inter-bore bridge width 120 may be reduced with the inclusion of inserts 110.

Turning now to FIG. 3, an exemplary embodiment of a truncated insert 300 is shown. Unlike insert 200, truncated insert 300 lacks a portion analogous to upper portion 209. However, truncated insert 300 comprises two sections: an upper section 302 and a lower section 304. As described above, truncated insert 300 is formed in a similar cracking or fracturing process where the insert may be first formed integrally, subsequently cracked along a pair of fault lines 306, and the resulting upper and lower sections 302 and 304 rejoined via one or more fastening means inserted at the bottom of insert 300 through boss ports 308. Boss ports 308 may provide a hollow or open region into which a fastening device may be received, and may extend vertically upward to respective bosses Truncated insert 300 includes other features present in insert 200, such as a plurality of serrations 310 circumferentially surrounding a pair of bosses 312, a dovetail region 314, and a lubricant passage 316. In this embodiment, truncated insert 300, when inserted in a cylinder block (e.g., cylinder block 100), may only partially traverse the vertical height of the cylinder block. For example, truncated insert may extend vertically from a crankcase (e.g., crankcase 106) to a midsection of the cylinder block and not to a cylinder head. Truncated insert 300 may be especially advantageous for use in downsized engines in which the reduction of size and weight are prioritized, and may reduce noise, vibration, and harshness associated with the insert and an adjacent components (e.g., a crankshaft inserted therethrough).

Similar to the insert of FIG. 2, insert 300 includes an upper web 397 connecting the upper bosses.

Turning now to FIG. 4, a schematic diagram of a left side view of a bulkhead insert 400 having a cracked cap in accordance with the present disclosure is shown. Bulkhead insert 400 may be insert 110 shown in FIG. 1 and discussed above, for example. In particular, FIG. 4 shows various components of insert 400; proceeding opposite vertical direction 206, insert 400 includes boss port 232 configured to receive an attachment or fastening device (e.g., a bolt) to rejoin upper portion 209 to cap 211. Boss port 232 may extend into cap boss 118, which may have features disposed on its external surface such as serrations 228. As described above, insert 400 may be fractured into upper portion 209 and cap 211 along cracks or fractures 210. Once rejoined, insert 400 may accommodate a crankshaft inserted therethrough and along crankshaft axis 104.

Insert 400 may include lubricant passage 224 extending outwardly from a left side and at least partially upwardly, partially opposite vertical direction 206. Insert 400 may truncate at a top end with upper boss 212, configured to receive an attachment or fastening device (e.g., a bolt) to secure insert 400 to surrounding portions of cylinder block 100 (e.g., a cylinder head). FIG. 4 illustrates how the profile of insert 400, in part characterized by its thickness, measured for example along crankshaft axis 104, may be minimized and reduced to a thickness suited to bosses 118 and 228 and the fastening devices they may receive. In this way, the thickness and overall size of insert 400 may be substantially reduced, in turn reducing weight and mass of the insert and an engine into which the insert may be disposed, and reducing widths between adjacent cylinder bores as described above with reference to FIG. 1. FIG. 4 also illustrates an embodiment in which insert 400 may have a substantially vertical and rectangular profile interrupted above cap 211 and at its top proximate boss 212 by sinuous, alternately extruding edges formed by bosses 118 and 212 and their serrations 228.

Turning now to FIG. 5, a schematic diagram of a right side view of a bulkhead insert 500 having a cracked cap in accordance with the present disclosure is shown. Bulkhead insert 500 may be insert 300 shown in FIG. 3 and discussed above, for example. In particular, FIG. 5 shows various components of insert 500, such as upper portion 302, bottom portion 304, one of fault lines 306, and lubricant passage 316. FIG. 5 also illustrates how the profile of insert 500, in part characterized by its thickness, may be minimized and reduced to a thickness suited to fastening devices inserted through the bosses. Combined with a reduced height profile, insert 500, when inserted into a cylinder block, may reduce overall engine weight, in turn improving fuel economy and operating efficiency.

It will be appreciated that the configurations and methods disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A cylinder block, comprising:

a plurality of cylinder bores;

a plurality of inserts, each adjacent pair of inserts of the plurality inserts partitioning each cylinder bore of the plurality of cylinder bores; and a crankcase disposed below the cylinder block in a vertical direction;

each insert of the plurality of inserts spanning a vertical length of the cylinder block and extending throughout a cylinder head disposed above the cylinder block, each insert having an upper portion, a cap disposed below the upper portion, the cap cracked from the upper portion at a pair of cracks and rejoined to the upper portion by one or more fastening devices, the upper portion having one or more upper bosses, each upper boss having a surface with extruded, circumferentially-extending serrations, and one or more cap bosses positioned below the one or more upper bosses, the one or more upper bosses and the one or more cap bosses positioned above the pair of cracks.

2. The cylinder block of claim 1, wherein the crankcase is a short skirt crankcase and does not vertically extend beyond a crankshaft axis.

3. The cylinder block of claim 1, wherein the cracks are angled relative to a horizontal axis.

4. The cylinder block of claim 1, wherein the one or more upper bosses are configured to receive a fastening device to thereby coupled a respective insert to the cylinder block.

5. The cylinder block of claim 1, wherein the upper bosses are enclosed by an outer perimeter of an insert.

6. The cylinder block of claim 1, wherein each insert further comprises a lubricant passage configured to supply lubricant to a crankshaft.

7. The cylinder block of claim 1, wherein each insert further comprises a crankshaft bore configured to support a crankshaft.

8. The cylinder block of claim 1, wherein each insert further comprises a plurality of spines configured to evenly distribute loads throughout an insert.

9. The cylinder block of claim 1, wherein the cylinder block is comprised of aluminum and each insert is comprised of compressed graphite iron.

10. The cylinder block of claim 1, wherein the cylinder block is comprised of aluminum and each insert is comprised of sintered metal.

11. A cylinder block, comprising:

a plurality of cylinder bores;

a plurality of bulkhead inserts comprised of compressed graphite iron, each adjacent pair of inserts of the plurality inserts partitioning each cylinder bore of the plurality of cylinder bores;

a crankcase disposed below the cylinder block in a vertical direction; and a crankcase skirt extending downward in the vertical direction from the crankcase;

each insert of the plurality of inserts spanning a vertical length of the cylinder block and extending throughout a cylinder head disposed above the cylinder block, each insert having a plurality of spines configured to distribute loads, an upper portion and a cap disposed below the upper portion, the cap cracked from the upper portion at a pair of angled fault lines and rejoined to the upper portion by one or more fastening devices, the upper portion having one or more upper bosses, each upper boss having a surface with extruded, circumferentially-extending serrations, each insert further having one or more cap bosses positioned below the one or more upper bosses, the one or more upper bosses and the one or more cap bosses positioned above the angled fault lines.

12. An engine, comprising:

a plurality of inserts, each adjacent pair of inserts of the plurality inserts partitioning each cylinder bore of an engine cylinder block;

a crankcase disposed vertically below the cylinder block; and each insert spanning a vertical length of the cylinder block and extending throughout a cylinder head disposed above the cylinder block, each insert having an upper portion and a lower cap, the cap cracked from the upper portion at a pair of fractures and rejoined to the upper portion by one or more fastening devices, the upper portion having two upper bosses each having a surface with extruded, circumferentially-extending serrations, a flat web connecting the two bosses, each insert further having one or more cap bosses positioned below the two upper bosses, the two upper bosses and the one or more cap bosses positioned above the pair of fractures.

13. The engine of claim 12, wherein the crankcase is a short skirt crankcase and does not vertically extend beyond a crankshaft axis.

14. The engine of claim 12, wherein the pair of fractures is angled relative to a horizontal axis of the engine.

15. The engine of claim 14, wherein each insert includes a port with an upper edge defined by the web.

16. The engine of claim 14, wherein each insert further comprises a lubricant passage configured to supply lubricant to a crankshaft.

17. The cylinder block of claim 14, wherein each insert further comprises a crankshaft bore configured to support a crankshaft.

18. The cylinder block of claim 14, wherein each insert further comprises a plurality of spines configured to evenly distribute loads throughout an insert.

19. The cylinder block of claim 14, wherein the cylinder block is comprised of aluminum and each insert is comprised of compressed graphite iron.

* * * * *